US008281534B2

(12) United States Patent
Bae et al.

(10) Patent No.: US 8,281,534 B2
(45) Date of Patent: Oct. 9, 2012

(54) FORMED STEEL BEAM FOR STEEL-CONCRETE COMPOSITE BEAM AND SLAB

(75) Inventors: Kyu woong Bae, Seoul (KR); Byung wook Heo, Goyang-si (KR)

(73) Assignee: Korea Institute of Construction Technology, Goyang-Si (KR)

( * ) Notice: Subject to any disclaimer, the term of this patent is extended or adjusted under 35 U.S.C. 154(b) by 0 days.

(21) Appl. No.: 13/128,224

(22) PCT Filed: Nov. 7, 2008

(86) PCT No.: PCT/KR2008/006585
§ 371 (c)(1),
(2), (4) Date: May 6, 2011

(87) PCT Pub. No.: WO2010/053220
PCT Pub. Date: May 14, 2010

(65) Prior Publication Data

US 2011/0247297 A1 Oct. 13, 2011

(51) Int. Cl.
*E04B 1/18* (2006.01)

(52) U.S. Cl. ..... 52/414; 52/435; 52/333; 52/334; 52/433

(58) Field of Classification Search ..... 52/263, 52/326, 333, 336, 338, 332, 334, 335, 337, 52/450, 630, 838, 842, 848, 414, 433, 328, 52/435

See application file for complete search history.

(56) References Cited

U.S. PATENT DOCUMENTS 2,970,676 A * 2/1961 Maciunas ..... 52/207
2,996,160 A * 8/1961 Voight ..... 52/376
3,845,594 A * 11/1974 Butts et al. ..... 52/98
4,691,493 A 9/1987 Larsen (Continued)

FOREIGN PATENT DOCUMENTS

GB 2206620 1/1989

(Continued)

*Primary Examiner* — William Gilbert
*Assistant Examiner* — Chi Q Nguyen
(74) *Attorney, Agent, or Firm* — IPLA P.A.; James E. Bame

(57) ABSTRACT

A built-up beam fabricated a plurality of profiled steel plates is disclosed. The built-up beam includes a first lower profiled steel plate including a bottom portion, a side-vertical portion bent upwardly and vertically from one lateral edge of the bottom portion, a supporting portion bent horizontally from an upper end of the side-vertical portion, and a first center-vertical portion bent vertically and upwardly from the other lateral edge of the bottom portion. A second lower profiled steel plate is arranged symmetrically about the first center-vertical portion of the first lower profiled steel plate and connected to the first lower profiled steel plate. The second lower profiled steel plate has a cross-section symmetrical or asymmetrical to the first lower profiled steel plate. The built-up beam includes a first upper profiled steel plate including a top face portion and a second center-vertical portion bent vertically and downwardly from one lateral edge of the top face portion, the first upper profiled steel plate being connected to one upper side of the first center-vertical portion of the first lower profiled steel plate. A second upper profiled steel plate is arranged symmetrically about the second center-vertical portion of the first upper profiled steel plate and connected to the other upper side of the first center-vertical portion of the second lower profiled steel plate. The second upper profiled steel plate has a cross-section symmetrical or asymmetrical to the first upper profiled steel plate. Thus, a slab can be placed within the depth to thereby reduce the story height.

14 Claims, 6 Drawing Sheets

U.S. PATENT DOCUMENTS

| | | | | | |
|---|---|---|---|---|---|
| 4,882,889 | A | * | 11/1989 | Healy et al. | 52/336 |
| 5,285,602 | A | * | 2/1994 | Felton | 52/36.6 |
| 5,544,464 | A | * | 8/1996 | Dutil | 52/330 |
| 5,553,437 | A | * | 9/1996 | Navon | 52/837 |
| 6,360,510 | B1 | * | 3/2002 | Woodrum et al. | 52/481.1 |
| 7,779,590 | B2 | * | 8/2010 | Hsu et al. | 52/334 |

FOREIGN PATENT DOCUMENTS

| | | |
|---|---|---|
| JP | 5-3402 | 1/1993 |
| JP | 2001-055809 | 2/2001 |
| KR | 1020060042561 | 5/2006 |

* cited by examiner

[Fig. 1]
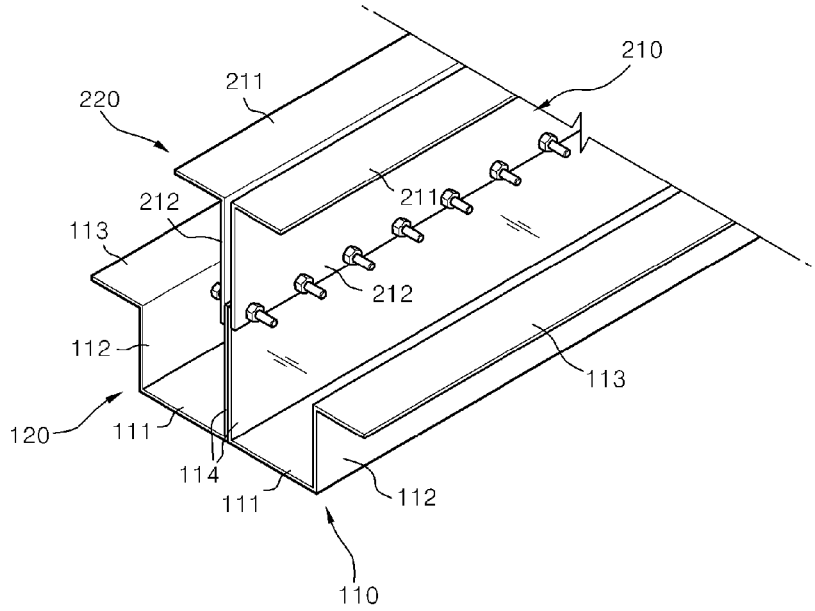
[Fig. 2]
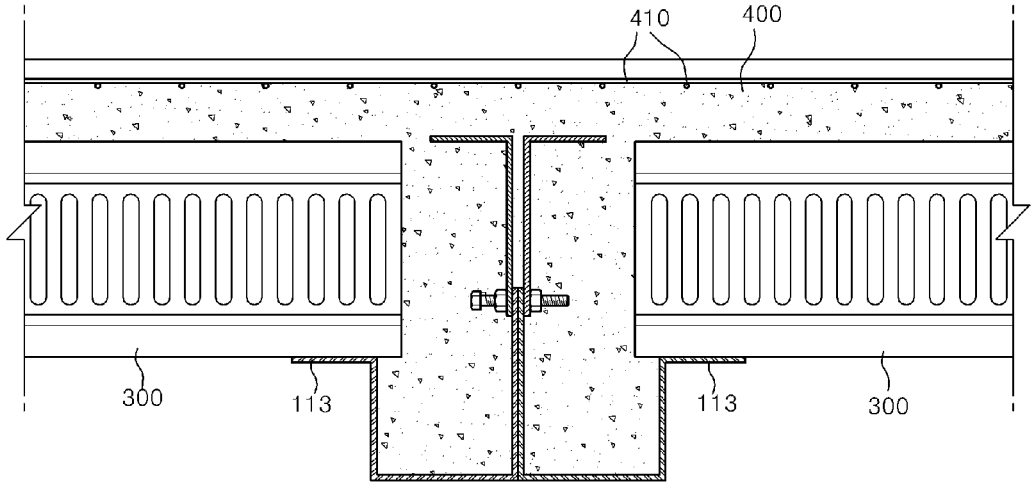

[Fig. 3]
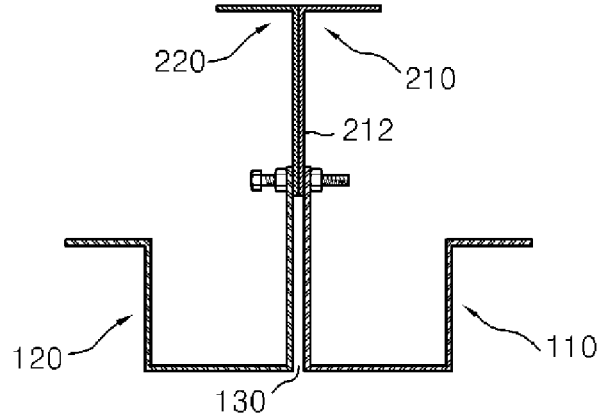
(a)
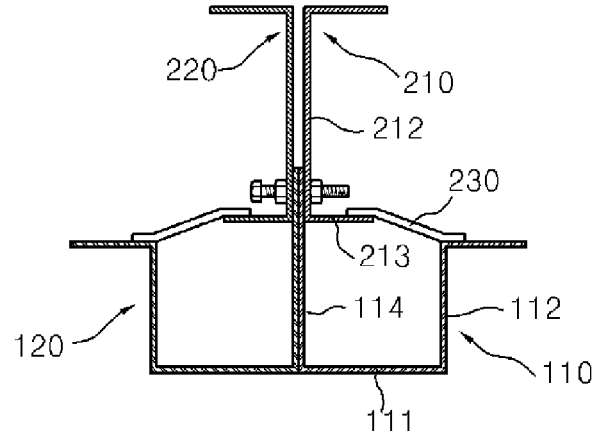
(b)
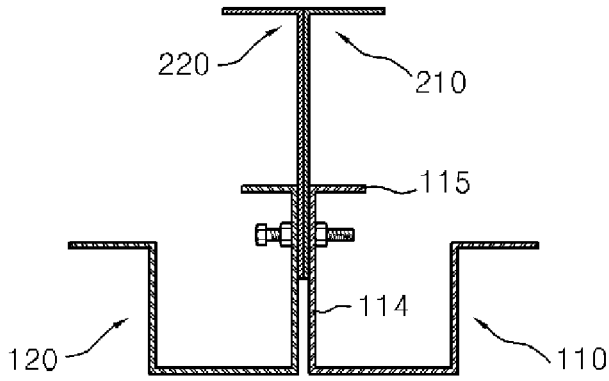
(c)

[Fig. 4]
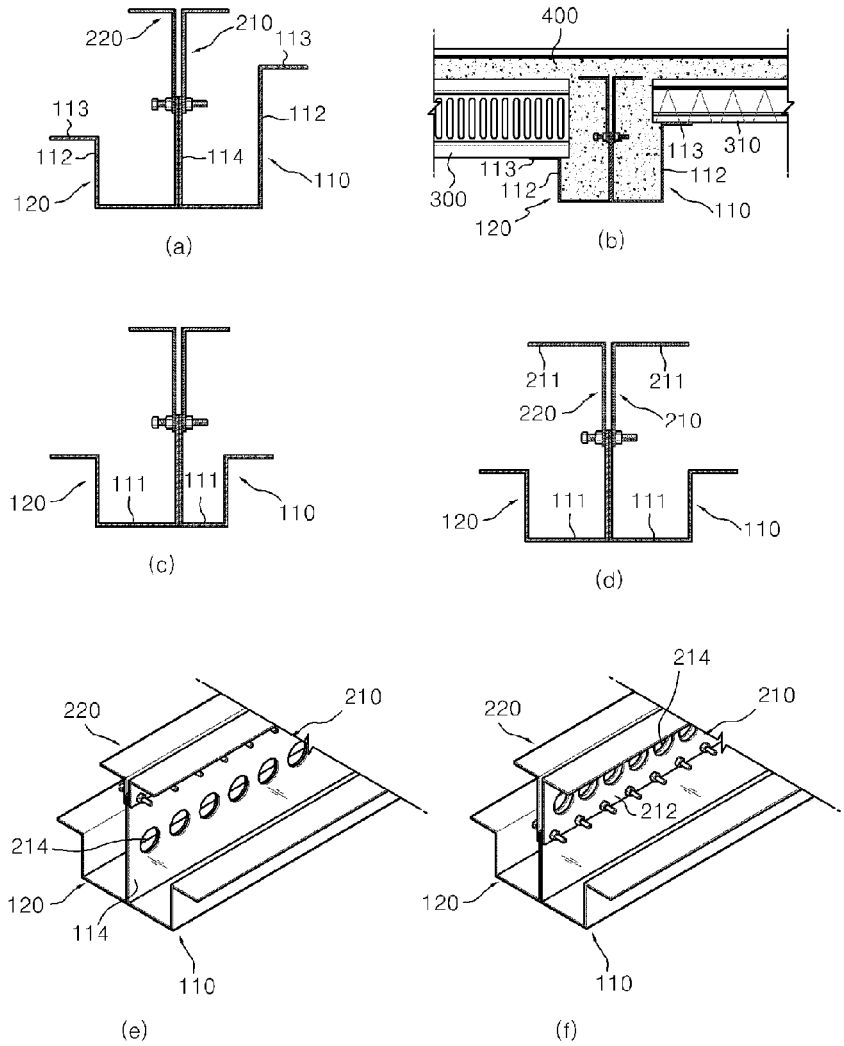
[Fig. 5]
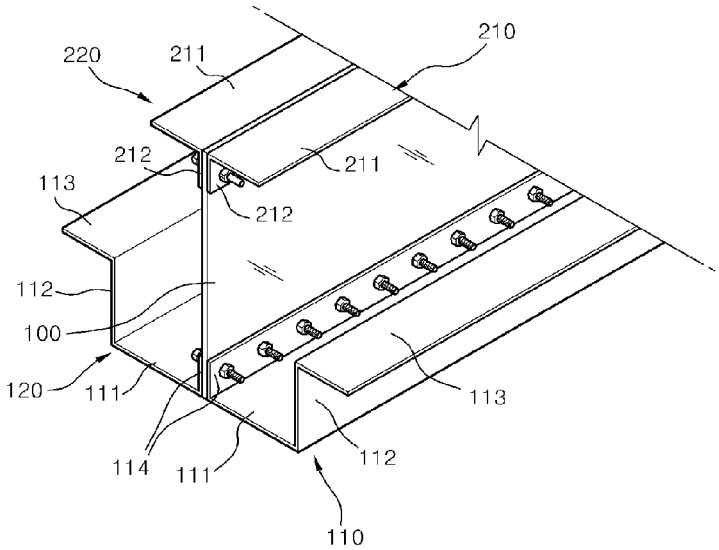

[Fig. 6]
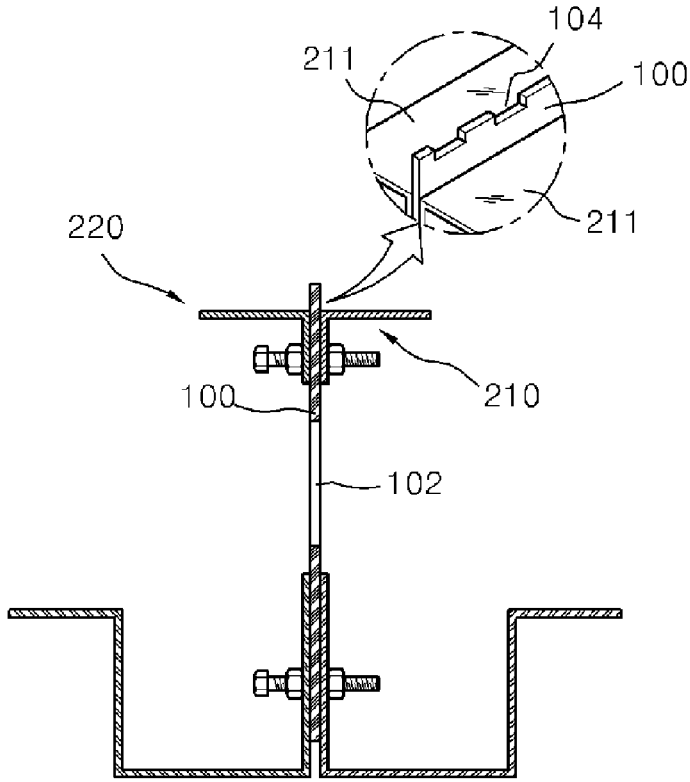
(a)
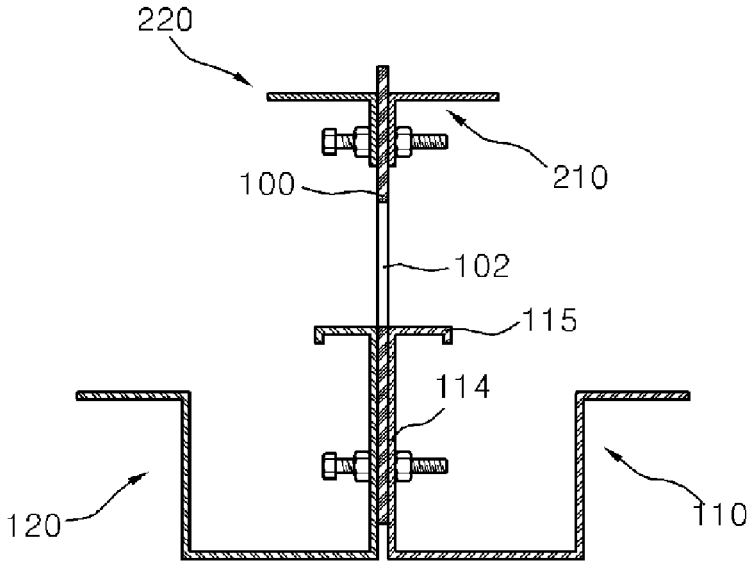
(b)

[Fig. 7]
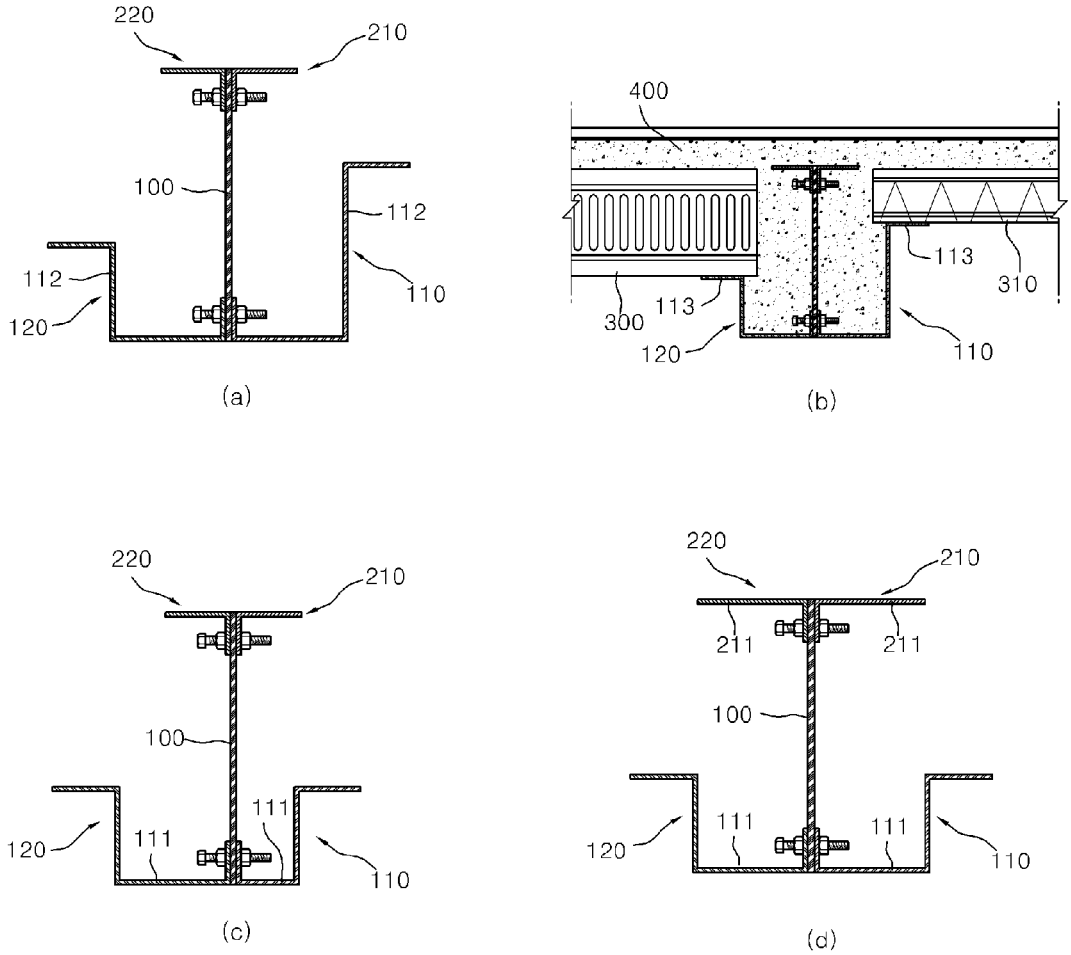
[Fig. 8]
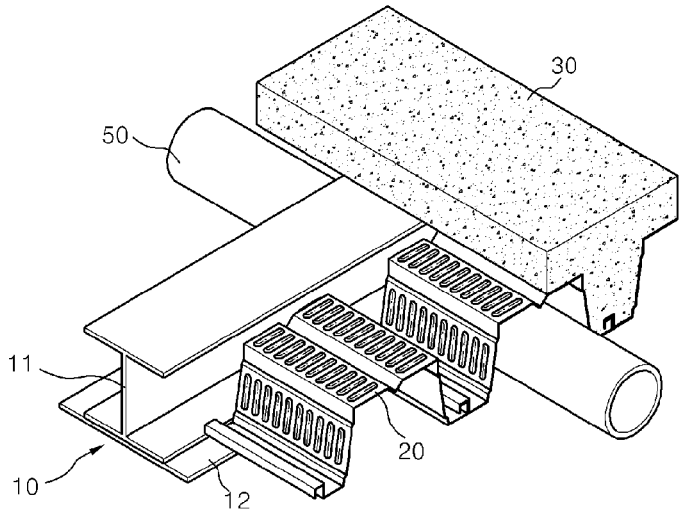

[Fig. 9]
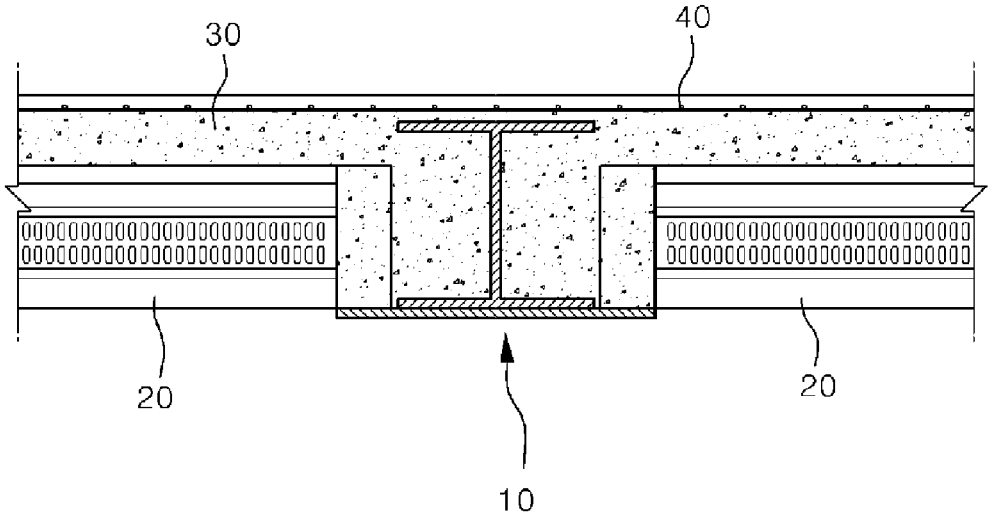

FORMED STEEL BEAM FOR STEEL-CONCRETE COMPOSITE BEAM AND SLAB

TECHNICAL FIELD

The present invention relates to built-up beam using a profiled steel plate, in which a slab can be placed within the depth of the beam, thereby enabling to reduce the story height.

BACKGROUND ART

A steel structure has advantageously flexibility in the space and superior structural stability and durability, as compared with a reinforced concrete structure. However, since a slab is placed on top of the steel beam, the entire story height increases disadvantageously. In order to solve this problem, various slim floor systems have been proposed and utilized, in which a slab is installed within the depth of the steel beam.

In the slim floor system, as illustrated in FIGS. 8 and 9, a slab employs a deep deck plate 20 or a hollow core precast concrete slab and, in order to support the slab, includes a asymmetrical steel beam where the width of the lower flange of the steel beam 10 is expanded. This is similar to a composite slab structure consisted of a deck plate and a concrete slab. However, dissimilar to the general composite slab, a plate 12 is additionally welded to the lower flange 11 of an H-shaped steel or angular steel pipe so that the deck plate is placed above the plate welded to the lower flange, to thereby reduce the story height. In case of this composite beam-slab system, the story height can be efficiently reduced, but applicable slab systems are restricted and thus the height of the composite beam-slab is limited. Therefore, it embraces limitation in the constructible span.

On the other hand, similarly the home-developed composite beam-slab system to reduce the story height has inconveniency such as a weak effect of reducing the story height and a lower applicable efficiency in fabrication of the steel beam and installation thereof. Moreover, due to the recent increase in the steel material price, there is a need to provide a composite beam-slab system capable of sufficiently utilizing a relatively inexpensive concrete, rather than a composite slab system using only the steel structure.

DISCLOSURE OF INVENTION

Technical Problem

The present invention has been made in order to solve the above problems in the art, and it is an object of the invention to provide a built-up beam using profiled steel plate, which can reduce the story height with freedom, regardless of the manufacturing specification of the composite slab, the beam span and the like, and simultaneously can cope with the high-rising trend of buildings, and improve constructability and cost-saving effect through omission of the floor form and arrangement of reinforcing bar.

Technical Solution

In order to accomplish the above object of the invention, according to one aspect of the invention, there is provided a profiled steel plate built-up beam fabricated a plurality of profiled steel plates, the beam comprising: a first lower profiled steel plate including a bottom portion, a side-vertical portion bent upwardly and vertically from one lateral edge of the bottom portion, a supporting portion bent horizontally from an upper end of the side-vertical portion, and a first center-vertical portion bent vertically and upwardly from the other lateral edge of the bottom portion; a second lower profiled steel plate arranged symmetrically about the first center-vertical portion of the first lower profiled steel plate and connected to the first lower profiled steel plate, the second lower profiled steel plate having a cross-section symmetrical or asymmetrical to the first lower profiled steel plate; a first upper profiled steel plate including a top face portion and a second center-vertical portion bent vertically and downwardly from one lateral edge of the top face portion, the first upper profiled steel plate being connected to one upper side of the first center-vertical portion of the first lower profiled steel plate; and a second upper profiled steel plate arranged symmetrically about the second center-vertical portion of the first upper profiled steel plate and connected to the other upper side of the first center-vertical portion of the second lower profiled steel plate, the second upper profiled steel plate having a cross-section symmetrical or asymmetrical to the first upper profiled steel plate, thereby enabling a slab to be placed within the depth to reduce the story height.

In an embodiment, the built-up beam may further comprise a first bent web portion bent horizontally and outwardly from the lower end of the second-vertical portion of the first and second upper profiled steel plates.

In an embodiment, the built-up beam may further comprise a second bent web portion bent horizontally and outwardly from the upper end of the first center-vertical portion of the first and second lower profiled steel plates.

In an embodiment, a plurality of openings is formed in the first center-vertical portion of the first and second lower profiled steel plates or in the second center-vertical portion of the first and second upper profiled steel plates.

In an embodiment, the built-up beam may further comprise a cover plate connecting the supporting portion with the first bent web portion or the second bent web portion to avoid departing from each other and cover a lower space in-between.

According to another aspect of the invention, there is provided a profiled steel plate built-up beam using a plurality of profiled steel plates, the beam comprising: an web steel plate; a first lower profiled steel plate connected to one side of the lower portion of the web steel plate, the first lower profiled steel plate including a bottom portion, a side-vertical portion bent vertically and upwardly from one lateral edge of the bottom portion and a first center-vertical portion bent vertically and upwardly from the other lateral edge of the bottom portion; a second lower profiled steel plate connected to the other side of the lower portion of the web steel plate so as to be symmetric with respect to the web steel plate, the second lower profiled steel plate having a cross-section symmetrical or asymmetrical to the first lower profiled steel plate; a first upper profiled steel plate connected to one side of the upper portion of the web steel plate, the first upper profiled steel plate including a top face portion and a second center-vertical portion bent vertically and downwardly from one lateral edge of the top face portion; and a second upper profiled steel plate connected to the other side of the upper portion of the web steel plate so as to be symmetric with respect to the web steel plate, the second upper profiled steel plate having a cross section symmetric or asymmetric to the first upper profiled steel plate.

In an embodiment, a plurality of openings is formed in the web steel plate.

In an embodiment, the built-up beam may further comprise a bent web portion bent horizontally and outwardly from the upper end of the first center-vertical portion of the first and second lower profiled steel plates.

In an embodiment, the first and second upper profiled steel plates are connected to both sides of the web steel plate in a way that part of the upper end of the web steel plate protrudes.

In an embodiment, a plurality of groove portions is formed in the top face of the web steel plate that protrudes above the top face portion of the first and second upper profiled steel plates.

Advantageous Effects

According to the present invention, since the height of the side-vertical portion at both ends of the profiled steel plate built-up beam can be adjusted and the steel plate is formed and manufactured in a factory, the production efficiency is excellent.

In addition, the composite beam-slab using the built-up beam is configured such that the filled concrete wraps around the center-vertical steel plate forming the inner web. Thus, its cross-sectional shape itself provides a considerable bonding capability. In a case where reinforcing bars are placed at the lower portion when required, a very good cross-sectional performance can be achieved in a cost-saving manner. Besides, the thermal performance by the concrete is increased to enable to reduce the cost for fire proofing.

Furthermore, for connection with the columns, the method in the conventional H-shaped steel composite beam-slab can be used as it is. Thus, additional installation or cost is not required and the construction can be carried out in a relatively easy way. A good rigidity in the connecting portion can be achieved.

BRIEF DESCRIPTION OF DRAWINGS

Further objects and advantages of the invention can be more fully understood from the following detailed description taken in conjunction with the accompanying drawings, in which:

FIG. 1 is a perspective view showing a profiled steel plate built-up beam according to the first embodiment of the invention;

FIG. 2 is a sectional view showing a steel-concrete composite beam-slab using the profiled steel plate built-up beam according to the first embodiment of the invention;

FIG. 3 illustrates modified examples to the profiled steel plate built-up beam according to the first embodiment of the invention;

FIG. 4 is a sectional view showing other modified examples to the profiled steel plate built-up beam according to the first embodiment of the invention;

FIG. 5 is a perspective view showing a profiled steel plate built-up beam according to the second embodiment of the invention;

FIG. 6 is a sectional view showing modified examples to the profiled steel plate built-up beam according to the second embodiment of the invention;

FIG. 7 is a sectional view showing other modified examples to the profiled steel plate built-up beam according to the second embodiment of the invention;

FIG. 8 is a perspective view showing a conventional slim floor system; and

FIG. 9 is a sectional view showing a conventional slim floor system.

BEST MODE FOR CARRYING OUT THE INVENTION

Hereinafter, preferred embodiments of the invention will be explained in detail with reference to the accompanying drawings. In the drawings, like elements are denoted by like reference characters. Details on well-known elements and functions will be omitted.

FIG. 1 is a perspective view illustrating a profiled steel plate built-up beam according to the first embodiment of the invention.

According to this embodiment, the profiled steel plate built-up beam is fabricated by connecting four profiled steel plates, which is fabricated by bending or roll-forming a thin steel plate having a thickness of about 1~10 mm. Therefore, a profiled steel plate built-up beam having a big depth can be provided while meeting the restriction on the steel width enabling to be formed.

Referring to FIG. 1, the profiled steel plate built-up beam of this embodiment comprises first and second lower profiled steel plates 110 and 120 face-contacted to each other, and first and second upper profiled steel plates 210 and 220 connected at both upper sides of a first center-vertical portion 114 of the first and second profiled steel plates 110 and 120.

The first and second lower profiled steel plates 110 and 120 have cross-sections identical to each other. The lower profiled steel plate is fabricated by shaping one piece of steel plate so as to have a bottom portion 111, a side-vertical portion 112 bent upwardly and perpendicularly from one lateral edge of the bottom portion 111, and a first center-vertical portion 114 bent upwardly and perpendicularly from the other lateral edge of the bottom portion 111, to thereby form a space inside of which concrete can be filled. A supporting portion 113 is formed by bending the upper end portion of the side-vertical portion 112 horizontally. A slab system is placed on the supporting portion 113. The supporting portion 113 may be formed by bending the steel plate inwardly or outwardly from the upper end portion of the side-vertical portion 112. In the case where the supporting portion 113 is bent inwardly, the slab is inserted inwardly into the steel beam cross-section. Therefore, the slab can behave more stably when it sags. Further, since the concrete is made completely wrapped around by the steel beam cross-section, the contact area can be increased to provide better composite effects. However, in case of an inwardly bent supporting portion, when pouring concrete, filling of the concrete into the inside of the steel beam is inconvenient, and it is not easy to secure tight-sealing. Further, the working conditions for reinforcing bar become inconvenient at the site. In addition, when the height of the side-vertical portion becomes higher, accessibility to the center-vertical portion is lowered so that workability of column-beam connection may be degraded. Therefore, to improve site-workability, it is preferable to bending the supporting portion outwardly. The first and second lower profiled steel plates 110 and 120 are face-contacted with each other and then connected to each other through a continuous or intermittent welding process.

The first and second upper profiled steel plates 210 and 220 have identical cross-sections to each other. More specifically, the upper profiled steel plate is fabricated by forming a steel plate so as to include a top face portion 211 and a second center-vertical portion 212 bent downwardly and vertically from one lateral edge of the top face portion 211.

The first and second upper profiled steel plates 210 and 220 are connected, by means of a bolt, to both upper opposite sides of the first center-vertical portion 114. In the case of the bolt-connection, the bolt can serve as a shear connector, which improves the bonding force between the profiled steel plate and the concrete to thereby avoid slip occurring in the interface in-between. However, the first and second upper profiled steel plates 210 and 220 can be welded to the first and second lower profiled steel plates 110 and 120, instead of the bolt-connection.

As described above, in the profiled steel plate built-up beam according to this embodiment, the bottom portion 111 of the first and second lower profiled steel plates 110 and 120 constitute a lower flange. The first and second center-vertical portion 114 of the first and second lower profiled steel plates 110 and 120, and the second center-vertical portion 212 of the first and second upper profiled steel plates 210 and 220 constitute an inner web. The top face portion 211 of the first and second upper profiled steel plates 210 and 220 constitute an upper flange. The side-vertical portion 112 serves as a form when pouring concrete and simultaneously serves as an outer web. The supporting portion 113 supports the slab system. Here, the depth of the web, which is formed by the first center-vertical portion 114 and the second center-vertical portion 212, is configured to be higher than the depth of the side-vertical portion 112, and the slab system is placed on the supporting portion 113 extended from the side-vertical portion 112. Therefore, the slab system is made to be placed inside the depth of the beam, thereby enabling to reduce the story height as much as the thickness of the slab system. In addition, the width of the lower flange, which is formed by the bottom portion 111 of the first and second lower profiled steel plates 110 and 120 being placed at the tension-side of the beam, is structured to be larger than the width of the upper flange, which is formed by the top face portion 211 of the first and second upper profiled steel plates 210 and 220 being placed at the compression-side of the beam, thereby forming a asymmetrical cross-section and thus becoming more efficient cross-section as a bending member. On the other hand, since the depth of the side-vertical portion 112 can be adjusted with freedom, various slab systems can be placed within the depth of the beam.

FIG. 2 is a sectional view showing a steel composite beam-slab using the profiled steel plate built-up beam according to the first embodiment of the invention.

As illustrated in FIG. 2, an end portion of a deck plate 300 is placed on the supporting portion 113 of the profiled steel plate built-up beam of this embodiment, a slab reinforcing bar 410 is arranged, and then concrete 400 is poured, thereby forming a composite beam-slab. In FIG. 2, the deck plate 300 is illustrated as being placed on the supporting portion 113. The slab system of the invention is not limited to the deck plate 300, a concrete products, i.e., a precast concrete floor may be placed. The composite beam-slab using a profiled steel plate built-up beam of this embodiment maximally uses advantages of concrete and steel materials. The upper compression zone minimizes the amount of upper steel materials and is embedded in concrete, to thereby achieving bond capability and fire-resistance and enabling easy installation of steel plate capable of contributing to bending-resistance of negative moment. In case of the side-vertical portion at both ends of the lower flange, its depth can be adjusted with freedom and thus applicable slab system is not particularly restricted and various spans and depth can be applied. In particular, the side-vertical portion at both ends of the lower flange serves as a form when pouring concrete, is configured to adjust its height so as to respond to various slab systems to be applied, and can provide improvement in the distortion and shear performance when being installed and composited.

FIG. 3 is cross-sectional views illustrating modified examples to the profiled steel plate built-up beam according to the first embodiment of the invention.

In the modified example illustrated in FIG. 3(*a*), the first and second upper profiled steel plates 210 and 220 are contacted and welded to each other, and the first and second lower profiled steel plates 110 and 120 are connected to the lower outer side of the second center-vertical portion 212. Since the first and second lower profiled steel plates 110 and 120 are connected so as to be spaced apart from each other to thereby form a space 130, an insert material to install a ceiling finish plate or a reinforcing plate can be easily fixed thereto, using the space 130. In the modified example illustrated in FIG. 3(*b*), the lower end of the second center-vertical portion 212 of the first and second upper profiled steel plates 210 and 220 is bent horizontally and outwardly to further form a first bent web portion 213. This first bent web portion 213 increases contact area with the concrete to improve composite action and improve restraining effect of the concrete filled in the space, which is formed by the center-vertical portions 114 and 212 and the side-vertical portion 112. Further, a cover plate 230 connecting the first bent web portion 213 with the supporting portion 113 is further provided to prevent the cross-section to be departed by load of workers while transporting or installing members and to further improve restraining effect of the concrete. In the modified example illustrated in FIG. 3(*c*), the upper end of the first center-vertical portion 114 of the first and second lower profiled steel plates 110 and 120 is bent horizontally and outwardly to further form a second bent web portion 115. This second bent web portion 115 further improves restraining effect of the concrete filled therein, similar to the first bent web portion 213 illustrated in FIG. 3(*b*).

FIG. 4 is a sectional view showing other modified examples to the profiled steel plate built-up beam according to the first embodiment of the invention.

In the above-described embodiments, the first and second lower profiled steel plates 110 and 120 and the first and second upper profiled steel plates 210 and 220 are bilaterally symmetric to each other. Alternatively, the first and second lower profiled steel plates 110 and 120 and the first and second upper profiled steel plates 210 and 220 may have a asymmetrical cross-section. That is, as illustrated in FIG. 4(*a*), by differentiating the length of the side-vertical portion 112, different slab systems may be placed on the supporting portion 113 of the first and second lower profiled steel plates 110 and 120. For example, as shown in FIG. 4(*b*), a deep deck plate 300 (also known as "Deep deck") may be rested on the supporting portion 113 of the second lower profiled steel plate 120 where the height of the side-vertical portion 112 is lower. Further, a shallow deck plate 310 (a deck plate where a truss steel bar is bonded to a steel plate, also known as "truss deck") may be installed on the supporting portion 113 of the first lower profiled steel plate 110 where the height of the lower profiled steel plate 110 is higher. In addition, as illustrated in FIG. 4(*c*), according to installation position of the beam, the width of the bottom portion 111 of the first and second lower profiled steel plates 110 and 120 can be differentiated. Furthermore, in the above-described embodiments, the bottom portions 111 of the first and second lower profiled steel plates 110 and 120 and the top face portion 211 of the first and second upper profiled steel plates 210 and 220 have different widths. However, as illustrated in FIG. 4(*d*), the bottom portion 111 and the top face portion 211 may have same widths. On the other hand, as shown in FIGS. 4(*e*) and 4(*f*), the first center-vertical portion 114 of the first and second lower profiled steel plates 110 and 120 or the second center-vertical portion 212 of the first and second upper profiled steel plates 210 and 220 may be formed with a plurality of openings 214. The concrete poured from the right and left of the center-vertical portions 114 and 212 can be connected by these openings 214. In addition, slab reinforcing bars can be easily passed through the openings 214 to thereby enable to improve horizontal shear-resistance. These openings can be used for electrical or plumbing installation.

FIG. 5 is a perspective view showing a profiled steel plate built-up beam according to the second embodiment of the invention.

In the profiled steel built-up beam according to this embodiment, first and second lower profiled steel plates 110 and 120 and first and second upper profiled steel plates 210 and 220 are connected to upper and lower sides of an web steel plate 100. The web steel plate 110 is formed of a flat plate. Similar to the above-described first and second lower profiled steel plates 110 and 120, the first and second lower profiled steel plates 110 and 120 have same cross-sectional shapes, and are profiled using a single steel plate so as to include a bottom portion 111, a side-vertical portion 112 bent vertically and upwardly from one lateral edge of the bottom portion 111, and a first center-vertical portion 114 bent vertically and upwardly from the other lateral edge of the bottom portion 111, thereby forming a space to which concrete can be filled. In order to place a slab system, the upper end of the side-vertical portion 112 is bent horizontally and inwardly or outwardly to form a supporting portion 113. In addition, similar to the first and second upper profiled steel plates 210 and 220, the first and second upper profiled steel plates 210 and 220 have same cross-sectional shapes, and are formed using a single steel plate so as to include a top face portion 211, and a second center-vertical portion 212 bent vertically and downwardly from one lateral edge of the top face portion 211. The web steel plate 100, the first and second lower profiled steel plates 110 and 120, and the first and second upper profiled steel plates 210 and 220 may be bolt-connected or welded to each other.

In the above-described profiled steel built-up beam according to this embodiment, the bottom portion 111 of the first and second lower profiled steel plates 110 and 120 form a lower flange. The web steel plate 110 forms an inner web. The top face portion 211 of the first and second upper profiled steel plates 210 and 220 form an upper flange. In addition, the side-vertical portion 112 serves as a form when pouring concrete and simultaneously forms an outer web. The supporting portion 113 supports a slab system. That is, in this embodiment, the first and second lower profiled steel plates 110 and 120 are connected to both sides of the lower portion of the web steel plate 100, and the first and second upper profiled steel plates 210 and 220 are connected to both sides of the upper portion of the web steel plate 100. By applying an web steel plate 100, the steel plate forming the inner web cannot be unnecessarily wasted to thereby provide an economical cross-section, dissimilar to the above first embodiment. Here, the height of the web forming the web steel plate 100 is formed so as to be higher than the height of the side-vertical portion 112, and the slab system is placed on the supporting portion 113 extended from the side-vertical portion 112. Therefore, the slab system is made to place within depth of the beam, thereby enabling to reduce the story height as much as the thickness of the slab system. In addition, the width of the lower flange, which is placed in the tension-side of the beam and formed by the bottom portion 111 of the first and second lower profiled steel plates 110 and 120, is wider than the width of the upper flange, which is placed in the compression-side of the beam. Thus, a asymmetrical cross-section can be provided to be more efficient as a bending member. On the other hand, the height of the side-vertical portion 112 can be adjusted with freedom, thereby enabling to install various slab systems within depth of the beam.

FIG. 6 is a sectional view showing modified examples to the profiled steel plate built-up beam according to the second embodiment of the invention.

In the modified example illustrated in FIG. 6(*a*), the first and second upper profiled steel plates 210 and 220 are connected to both sides of the web steel plate 110 in such a way that part of the upper end of the web steel plate 100 protrudes. Further, a plurality of groove portions is formed in the top face of the web steel plate 200 protruding above the top face portion of the first and second upper profiled steel plates 210 and 220. A plurality of openings 102 is formed in the web steel plate 100. These openings 102 provide continuity with neighboring concrete, and simultaneously improve integrity with the concrete through the Dowel action. Further, the lower reinforcing bars of the slab can easily pass through the openings to thereby enable to improve horizontal shear-resistance. These openings can be used for installation space for electrical and plumbing facilities. In the modified example illustrated in FIG. 6(*b*), a bent web portion 115 is further formed, which is bent horizontally and outwardly from the upper end of the first center-vertical portion 114 of the first and second lower profiled steel plates 110 and 120. This bend web portion 115 can improve restraining effect of the concrete filled in the space, which is formed by the center-vertical portion and the side-vertical portion of the lower profiled steel plate.

FIG. 7 is a sectional view showing other modified examples to the profiled steel plate built-up beam according to the second embodiment of the invention.

In the above-described embodiments, the first and second lower profiled steel plates 110 and 120 and the first and second upper profiled steel plates 210 and 220 are explained to be bilaterally symmetric to each other. Alternatively, the first and second lower profiled steel plates 110 and 120 and the first and second upper profiled steel plates 210 and 220 may have a asymmetrical cross-section. That is, as illustrated in FIG. 7(*a*), by differentiating the length of the side-vertical portion 112, different slab systems may be rested on the supporting portion 113 of the first and second lower profiled steel plates 110 and 120. For example, a deep deck plate 300 (also known as "Deep deck") may be placed on the supporting portion 113 of the second lower profiled steel plate 120 where the length of the side-vertical portion 112 is short. Further, a shallow deck plate 310 (a deck plate where a steel bar truss is bonded to a steel plate, also known as "truss deck") may be installed on the supporting portion 113 of the first lower profiled steel plate 110 where the length of the lower profiled steel plate 110 is long. In addition, as illustrated in FIG. 7(*b*), the width of the bottom portion 111 of the first and second lower profiled steel plates 110 and 120 can be differentiated. Furthermore, in the above-described embodiments, the bottom portions 111 of the first and second lower profiled steel plates 110 and 120 and the top face portion 211 of the first and second upper profiled steel plates 210 and 220 are explained to have different widths. However, as illustrated in FIG. 7(*c*), the bottom portion 111 and the top face portion 211 may have same widths.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

Industrial Applicability

The present invention provides an excellent structural efficiency and time- and cost-saving effects for construction. Thus, it can be widely used as a steel composite beam for reducing the story height.

The invention claimed is:

1. A built-up beam fabricated a plurality of profiled steel plates, the beam comprising:

a first lower profiled steel plate including a bottom portion, a side-vertical portion bent upwardly and vertically from one lateral edge of the bottom portion, a supporting portion bent horizontally from an upper end of the side-vertical portion, and a first center-vertical portion bent vertically and upwardly from the other lateral edge of the bottom portion;

a second lower profiled steel plate arranged symmetrically about the first center-vertical portion of the first lower profiled steel plate and connected to the first lower profiled steel plate, the second lower profiled steel plate having a cross-section symmetrical or asymmetrical to the first lower profiled steel plate;

a first upper profiled steel plate including a top face portion and a second center-vertical portion bent vertically and downwardly from one lateral edge of the top face portion, the first upper profiled steel plate being connected to one upper side of the first center-vertical portion of the first lower profiled steel plate; and a second upper profiled steel plate arranged symmetrically about the second center-vertical portion of the first upper profiled steel plate and connected to the other upper side of the first center-vertical portion of the second lower profiled steel plate, the second upper profiled steel plate having a cross-section symmetrical or asymmetrical to the first upper profiled steel plate, thereby enabling a slab to be placed within the depth to reduce the story height, wherein the first center-vertical portions and the second center-vertical portions are connected to each other by bolts to form an inner web; a height of said inner web extending from the bottom portions of the first and second lower profiled steel plates to the top face portions of the first and second upper profiled steel plates.

2. The built-up beam according to claim 1, further comprising a first bent web portion bent horizontally and outwardly from the lower end of the second-vertical portion of the first and second upper profiled steel plates.

3. The built-up beam according to claim 2, wherein a plurality of openings is formed in the first center-vertical portion of the first and second lower profiled steel plates or in the second center-vertical portion of the first and second upper profiled steel plates.

4. The built-up beam according to claim 1, further comprising a second bent web portion bent horizontally and outwardly from the upper end of the first center-vertical portion of the first and second lower profiled steel plates.

5. The built-up beam according to claim 4, wherein a plurality of openings is formed in the first center-vertical portion of the first and second lower profiled steel plates or in the second center-vertical portion of the first and second upper profiled steel plates.

6. The built-up beam according to claim 1, wherein a plurality of openings are formed in the first center-vertical portion of the first and second lower profiled steel plates or in the second center-vertical portion of the first and second upper profiled steel plates.

7. The built-up beam according to claim 6, further comprising a cover plate connecting the supporting portion with the first bent web portion or the second bent web portion to avoid departing from each other and cover a lower space in-between.

8. A built-up beam fabricated a plurality of profiled steel plates, the beam comprising:

an web steel plate;

a first lower profiled steel plate connected to one side of the lower portion of the web steel plate, the first lower profiled steel plate including a bottom portion, a side-vertical portion bent vertically and upwardly from one lateral edge of the bottom portion and a first center-vertical portion bent vertically and upwardly from the other lateral edge of the bottom portion;

a second lower profiled steel plate connected to the other side of the lower portion of the web steel plate so as to be symmetric with respect to the web steel plate, the second lower profiled steel plate having a cross-section symmetrical or asymmetrical to the first lower profiled steel plate;

a first upper profiled steel plate connected to one side of the upper portion of the web steel plate, the first upper profiled steel plate including a top face portion and a second center-vertical portion bent vertically and downwardly from one lateral edge of the top face portion; and a second upper profiled steel plate connected to the other side of the upper portion of the web steel plate so as to be symmetric with respect to the web steel plate, the second upper profiled steel plate having a cross section symmetric or asymmetric to the first upper profiled steel plate, wherein the first and second lower profiled steel plates and the first and second upper profiled steel plates are connected by bolts through the web steel plate; and a height of said web steel plate extending from the bottom portions of the first and second lower profiled steel plates to the top face portions of the first and second upper profiled steel plates.

9. The built-up beam according to claim 8, wherein a plurality of openings is formed in the web steel plate.

10. The built-up beam according to claim 9, further comprising a bent web portion bent horizontally and outwardly from the upper end of the first center-vertical portion of the first and second lower profiled steel plates.

11. The built-up beam according to claim 9, wherein the first and second upper profiled steel plates are connected to both sides of the web steel plate in a way that part of the upper end of the web steel plate protrudes.

12. The built-up beam according to claim 8, further comprising a bent web portion bent horizontally and outwardly from the upper end of the first center-vertical portion of the first and second lower profiled steel plates.

13. The built-up beam according to claim 8, wherein the first and second upper profiled steel plates are connected to both sides of the web steel plate in a way that part of the upper end of the web steel plate protrudes.

14. The built-up beam according to claim 13, wherein a plurality of groove portions is formed in the top face of the web steel plate that protrudes above the top face portion of the first and second upper profiled steel plates.

* * * * *